US005131545A

United States Patent [19]

Owen

[11] Patent Number: 5,131,545

[45] Date of Patent: Jul. 21, 1992

[54] METHOD AND APPARATUS FOR EXTRACTING THE CONTENTS OF ENVELOPES

[75] Inventor: Trevor W. Owen, Mississauga, Canada

[73] Assignee: Owen Tri-Cut, Mississauga, Canada

[21] Appl. No.: 665,194

[22] Filed: Mar. 4, 1991

[51] Int. Cl.[5] ..... B07C 5/08

[52] U.S. Cl. ..... 209/604; 53/381.5; 209/900; 271/2; 271/33; 414/418

[58] Field of Search ..... 209/603, 604, 643, 657, 209/900, 905; 271/2, 33; 414/418; 53/381.3, 381.5; 83/912

[56] References Cited

U.S. PATENT DOCUMENTS

| | | | |
|---|---|---|---|
| 3,301,116 | 1/1967 | Owen | 83/673 X |
| 3,884,010 | 5/1975 | Bardo et al. | 414/412 X |
| 3,952,874 | 4/1976 | Owen | 209/545 |
| 4,576,287 | 3/1986 | Bingham et al. | 209/604 X |
| 4,625,497 | 12/1986 | Owen | 53/381.5 X |
| 4,863,037 | 9/1989 | Stevens et al. | 209/604 X |

FOREIGN PATENT DOCUMENTS

| | | | |
|---|---|---|---|
| 2561632 | 9/1985 | France | 209/900 |

*Primary Examiner*—Donald T. Hajec
*Assistant Examiner*—Joseph A. Kaufman
*Attorney, Agent, or Firm*—Bereskin & Parr

[57] ABSTRACT

A method and apparatus for extracting the contents of envelopes, each of which has been opened along at least one edge and has an opposite edge which is unopened. The envelopes are successively projected with their unopened edges leading, against an adhesive surface of a travelling belt. The belt is subsequently oriented so that the envelopes are suspended therefrom and the belt is simultaneously vibrated to cause the contents of the envelopes to migrate downwardly and leave the envelopes. The contents are conveyed in an orderly fashion on a belt conveyor and formed into a stack. The empty envelopes are stripped from the belt. The adhesive surface on the belt is formed by renewable adhesive strips.

27 Claims, 16 Drawing Sheets

METHOD AND APPARATUS FOR EXTRACTING THE CONTENTS OF ENVELOPES

FIELD OF THE INVENTION

This invention relates generally to mail processing equipment and is concerned more particularly with a method and apparatus for extracting the contents of envelopes.

BACKGROUND OF THE INVENTION

Opening of envelopes and extraction and handling of their contents represents a significant labour cost for credit card companies, utilities and other organizations that receive large volumes of mail. For example, a credit card company or the like may receive tens of thousands of envelopes each day. Every envelope must be opened and its contents must be extracted, checked, sorted and processed. Many of the envelopes will contain an invoice or a remittance advice and a corresponding cheque. In some cases, one or other of these items will be missing or there will be a discrepancy between the cheque and the amount on the remittance advice; in other cases, correspondence will be included.

While the envelopes can be opened automatically, extraction of their contents and subsequent processing is usually performed manually. An analysis by the Bank Administration Institute in 1968 identified eight different categories into which incoming mail would be sorted in a typical remittance processing operation. That study showed that the average processing time for each piece of mail was 9.98 seconds after the envelope had been opened and that 5.88 seconds of this time was required to obtain the envelope and remove its contents. This corresponds to processing of only 361 items per hour for each operator. Since delays in processing remittances represent lost bank interest, organizations that receive large volumes of mail employ large numbers of operators to ensure that remittances reach the bank promptly.

Not only is the labour cost significant but the type of work (repetitious manual work) has recently been identified as a possible cause of health problems in employees — see for example Item Processing Report (ISSN 1048-5120) published by Phillips Publishing Inc. of Maryland, U.S.A.

DESCRIPTION OF THE PRIOR ART

Automatic equipment for opening envelopes is disclosed in U.S. Pat. Nos. 3,301,116 and 3,952,874 both issued to Trevor Owen and is commercially available under the trade-mark TRI-CUT from Bell & Howell Inc. of Chicago, Ill. The TRI-CUT 3-WAY LETTEROPENER opens each envelope along the bottom longitudinal edge and each end edge. Qpened envelopes are delivered to an operator in batches from the TRI-CUT 3-WAY LETTEROPENER but the operator must still separate the contents from the front and rear sheets that made up the envelope.

In a remittance processing operation, the contents of the envelope will typically comprise two relatively thin sheets, namely a cheque and a remittance advice or invoice as discussed previously. In practice, there is a natural tendency for these items to cling to the front and rear sheets that made up the envelope and in some cases the remittance advice and cheque may even be trapped in the unopened edge that was at the top of the envelope. These factors make it awkward for the operator to remove the contents from the envelope and to some extent account for the large amount of the overall processing time that is occupied by removal of the contents of the envelope. It is also at least partly because of these difficulties that contents extraction from envelopes is generally performed by hand.

U.S. Pat. No. 4,625,497, also to Trevor W. Owen, discloses an envelope extraction device that is sold under the trade-mark AUTOCORE. Batches of envelopes that have previously been opened along one longitudinal edge and two end edges are secured to a support by their unopened edges and the support is vibrated to dislodge the contents. While the AUTOCORE device has found commercial acceptance, a limitation is that the envelopes can be processed in batches only.

An object of the present invention is to provide a method and apparatus for extracting the contents of envelopes which can operate continuously.

SUMMARY OF THE INVENTION

In one aspect, the invention provides a method of extracting the contents of envelopes, each of which has been opened along at least one edge and has an opposite edge which is unopened. The method involves the steps of providing a travelling belt having an adhesive surface, causing each of a succession of envelopes to adhere to the adhesive by projecting each envelope against the said surface with its unopened edge leading, and subsequently orienting the belt so that the envelopes hang down from the belt, while vibrating the belt to cause the contents of the envelope to migrate downwardly and leave the envelopes.

Preferably, the belt is an endless belt and the method is performed on a continuous basis. In that case, successive envelopes will be continuously projected against the travelling belt at a first station at which the envelopes are adhered to the belt. Downstream of that station, the belt will travel, for example, generally horizontally while being vibrated to extract the contents. The empty envelopes will be removed from the belt at a subsequent location and the belt will then return to the first station. Of course, the operation may not be continuous in the sense that the supply of pre-opened envelopes will vary. Opening of the envelopes may ideally be performed using a TRI-CUT 3-WAY LETTEROPENER of the type referred to above.

While it may be possible for the entire surface of the belt against which the envelopes are projected to be adhesively coated, in practice, it has been found convenient to provide a non-adhesive belt with at least one and preferably two or three relatively narrow adhesive strips that extend parallel to one another longitudinally of the belt. Double-sided adhesive tape is preferably used for the strips. The exposed faces of the strips inevitably lose their adhesive qualities as the envelopes are applied to and removed from the strips. Accordingly, it is desirable to be able to renew the adhesive by either replacing the strips or adding new strips over the old strips. In a practical apparatus it may be that fresh strips would be applied over the old strips at intervals during the working day and that the belt would be cleaned by removing the accumulated layers of strips at the end of the day.

In another aspect there is provided an apparatus for extracting the contents of envelopes, each of which has been opened along at least one edge, and has an opposite edge which is unopened. The apparatus includes a belt having an adhesive surface, means for transporting the belt in the direction of its length, and means for projecting against said adhesive surface a succession of envelopes, each with its unopened edge leading so as to cause the envelope to adhere to the belt by its said unopened edge. The belt transport means is arranged to orient the belt so that the envelopes hang down from the belt and means is provided for vibrating the belt so as to cause the contents of the envelope to migrate downwardly and leave the envelopes.

BRIEF DESCRIPTION OF DRAWINGS

In order that the invention may be more clearly understood, reference will now be made to the accompanying drawings which illustrate a particular preferred embodiment of the invention by way of example, and in which.

DESCRIPTION OF PREFERRED EMBODIMENT

Figure 1:
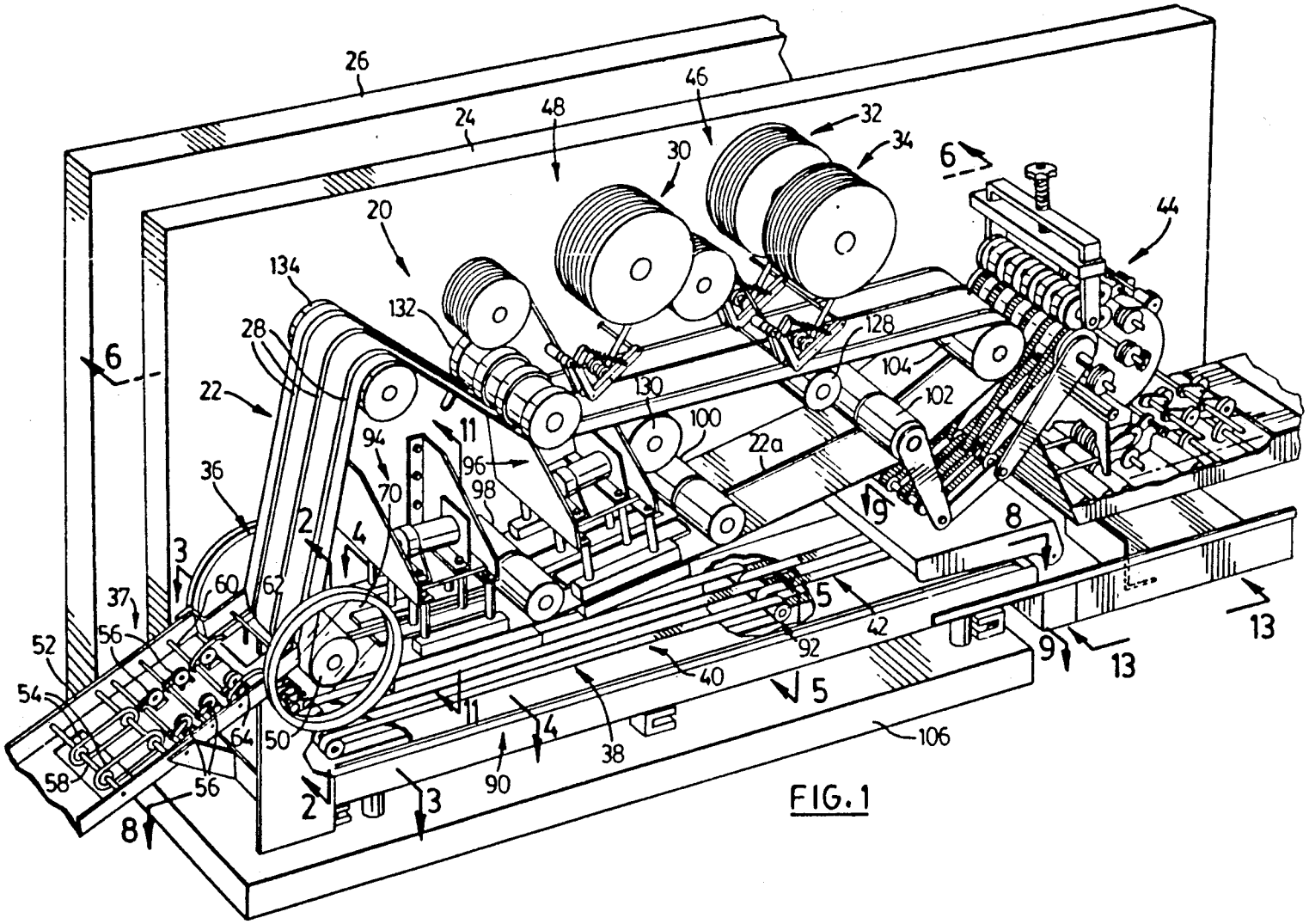
FIG. 1 is a perspective view from above and one end of an apparatus in accordance with the invention.

Referring first to FIG. 1, the apparatus provided by the invention is generally denoted by reference numeral 20 and includes an endless belt 22 that extends in a closed path around the various rollers that are visible in the drawing. The belt has a central longitudinal rib 22*a* in its lower surface which is received in a corresponding circumferential groove in each roller, for locating the belt laterally. The rollers are supported on respective shafts that extend outwardly in "cantilever" fashion from a relatively sturdy, vertically disposed base plate 24. A second similar plate 26 is positioned behind and at a spacing from plate 24 and the space between the two plates accommodates the bearings for the shafts (not shown) and the drive system of the apparatus (to be described). Three strips of adhesive tape are visible on the outer surface of the belt at 28. Respective tape applying mechanisms are shown at 30, 32 and 34 on base plate 24. These mechanisms are of essentially conventional form.

Figure 5:
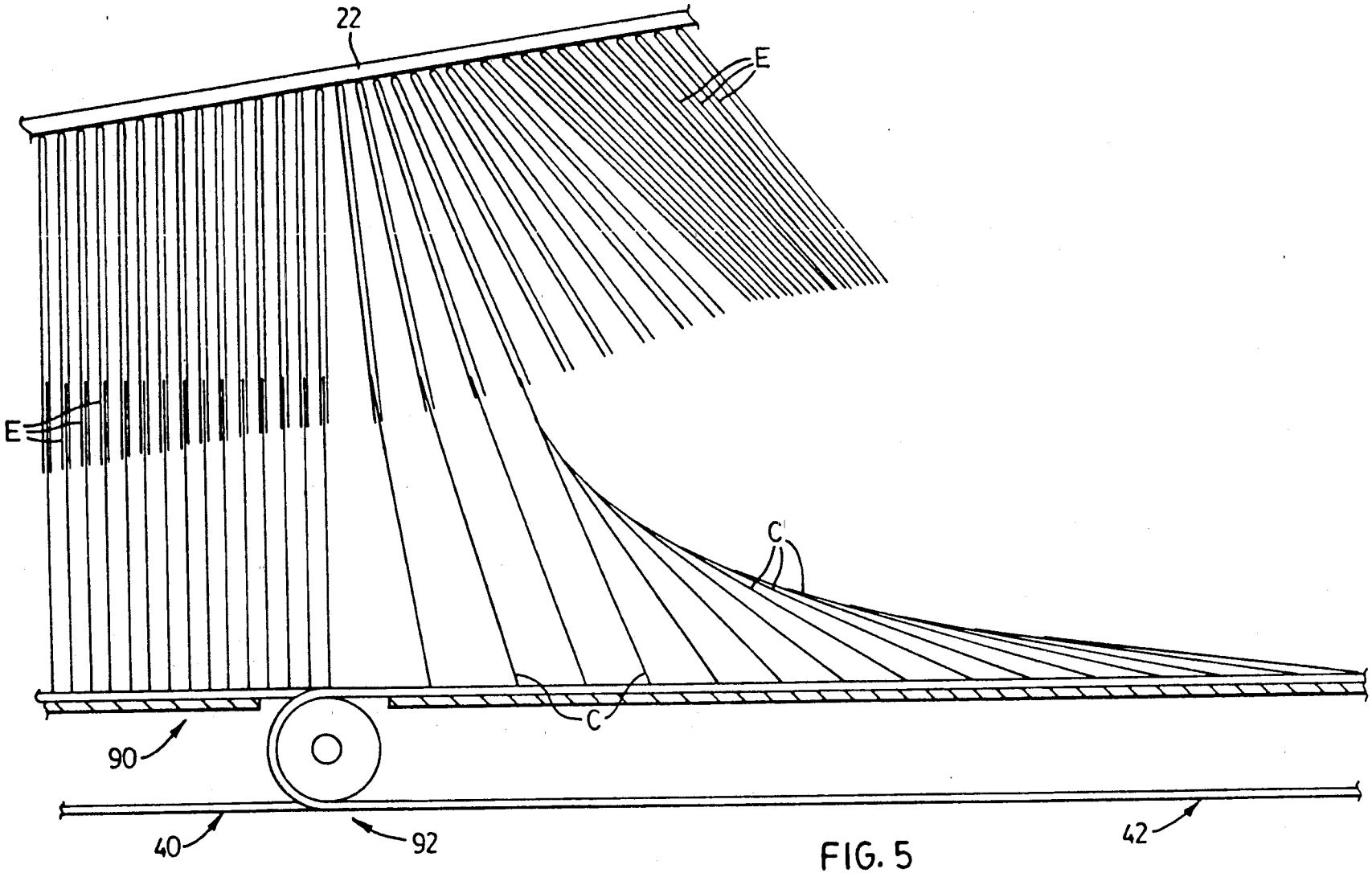

Envelopes containing items to be extracted (contents) are projected against belt 22 at a first station 36 along the path of the belt. These envelopes arrive on a conveyor 37 from an "upstream" part of the mail processing system (not shown). These envelopes will have been opened on three sides and will be projected towards belt 22 with their unopened edges leading and disposed transversely of the belt and will adhere to the belt by their unopened edges. From station 36, the bottom run of the belt travels to the right in FIG. 1, through a station generally indicated at 38 at which the envelopes hang down from the belt and the belt is vibrated to cause the contents of the envelopes to migrate downwardly and leave the envelopes, as best shown in FIG. 5. The contents of the envelopes are received on lower belt conveyors indicated generally at 40 and 42. Leaving station 38, the main belt rises away from the lower belt conveyors and approaches an envelope stripping station generally indicated 44, at which the empty envelopes are removed from the belt. The belt then travels through tape applicator stations 46 and 48 at which the mechanisms 30, 32 and 34 apply the adhesive tape to the belt and the belt then returns around an upper roller to the first station 36.

As the belt approaches station 36, it follows a relatively steep, almost vertical portion of its path. The belt then curves round a roller 50 at station 36 and then travels substantially horizontally to station 38. Incoming envelopes to be adhered to the belt are conveyed at relatively high speed towards the belt by conveyor 37 and impact the belt at the location of roller 50.

Conveyor 37 essentially comprises a long and relatively shallow tray 52 only part of which is shown in the drawings. The envelopes are conveyed as a series of single or pairs of envelopes that lie flat on the conveyor in a plane parallel to the base of the tray, by a series of endless belts 54 and rollers 56. In FIG. 1, only one pair of endless belts 54 have been shown, although in practice, the tray includes a number of similar pairs of belts arranged to convey the envelopes towards the upper end of the tray. The belts are internally toothed rubber belts and extend around toothed wheels on respective shafts 58 that extend transversely of the tray.

Adjacent the upper end of the tray are similar shafts 60 to which the wheels 56 are pivoted by short pivot arms. The wheels 56 run in contact with similar wheels that project upwardly through openings in the base of the tray and by which the wheels 56 are frictionally driven. Drive belts for these wheels and for the belts 54 are provided below the tray but have not been shown in detail. For present purposes, it is sufficient to note that the upper runs of the belts 54 (and the associated belts further down the tray) together with the wheels 56 in effect define a notional plane in which the envelopes are supported flat and parallel to the base of the tray. The drive arrangement for the belts and rollers is designed to accelerate the envelopes as they travel up the conveyor.

Figure 2:
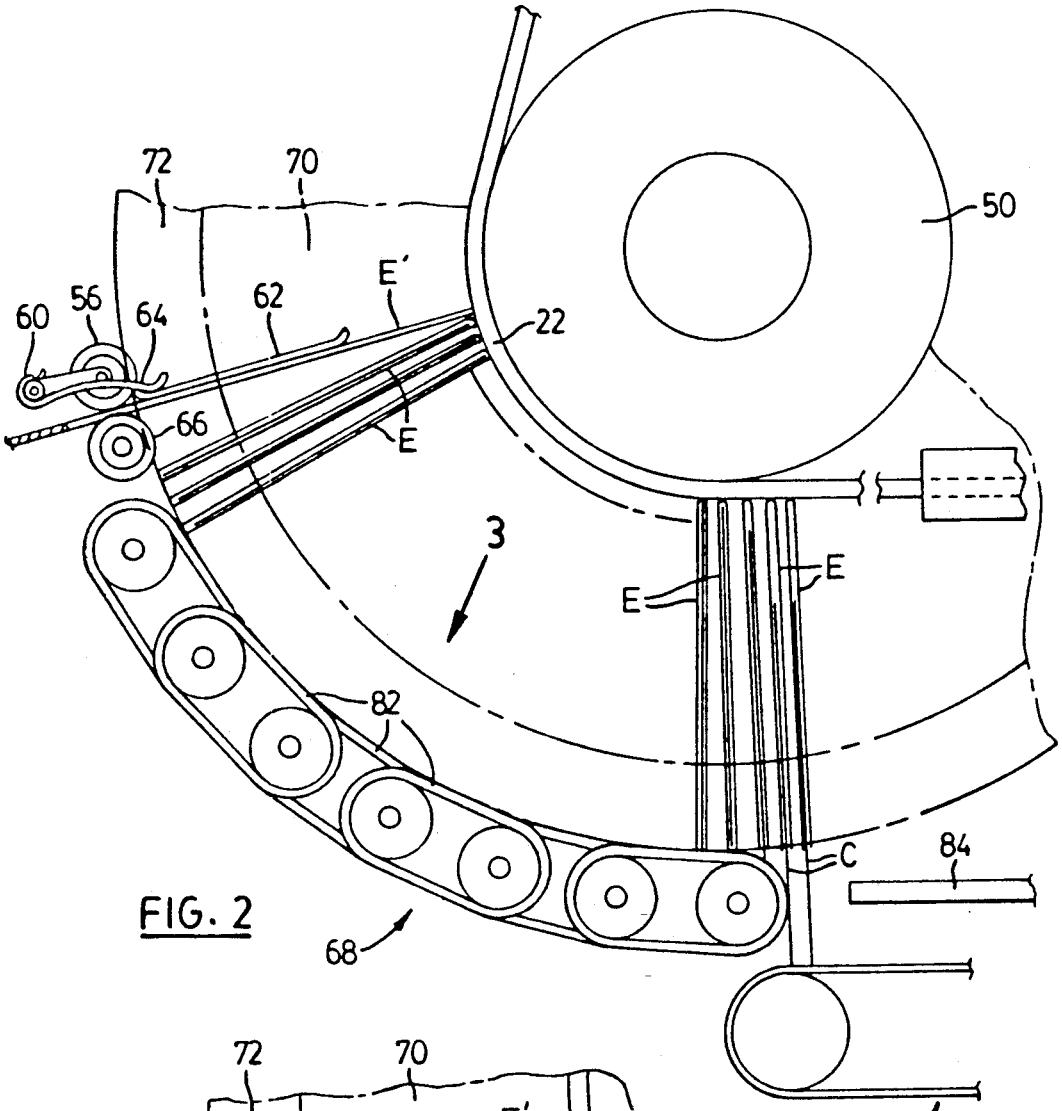
FIG. 2 is a sectional view on line 2—2 of FIG. 1.

Conveyor 37 operates at a constant speed, delivering the opened envelopes singly or in pairs to the main belt 22. The speed of the belt can be adjusted to produce the optimum spacing for the envelopes being processed. Thus, successive envelopes will become adhered to the belt in parallel positions transverse to and spaced along the length of the belt. FIG. 2 shows a series of such envelopes. Each envelope is denoted by the letter E and contents of the envelope by the letter C. As noted previously, each envelope has previously been opened along three edges and has been projected against the belt 22 with its unopened edge leading so that the envelope becomes adhered to the belt by that edge.

The most recently arrived envelope is indicated at E' in FIG. 2 immediately below a stationary guide plate 62 which helps ensure proper orientation of the envelope with respect to the belt. Plate 62 is also visible in FIG. 1, as are a pair of springs 64 disposed one on each side of plate 62. The springs are pivoted to one of the transverse shafts 60 at their outer ends and extend towards roller 50 at their inner ends. Adjacent those ends, each spring has a curved end portion designed to provide a rounded lower surface to rest on the envelope. Thus, the two springs apply a light downward force to the outer end portion of each successive envelope. In FIG. 2, one of the rollers 56 is visible adjacent one of the springs 64. Also visible is a companion roller 66 for roller 56, by which roller 56 is driven. Rollers 56 and 66 are referred to as ejection drive rollers.

The envelopes are driven (singly or in pairs) against the three adhesive strips 28 on the main belt 22 at a point on a line slightly above the centre of the conveyor roller 50. The envelopes may or may not adhere to the adhesive initially. The trailing end portion of each envelope is pressed down by springs 64. The two ejection drive rollers 56, 66 force the envelope forward to give positive bonding with the adhesive on the belt 22 and down onto a ledge 67 (FIG. 2*a*), aided by the springs 64. The envelopes rest momentarily on the ledge before being pulled down and away by the rotation of the belt.

Figure 2A:
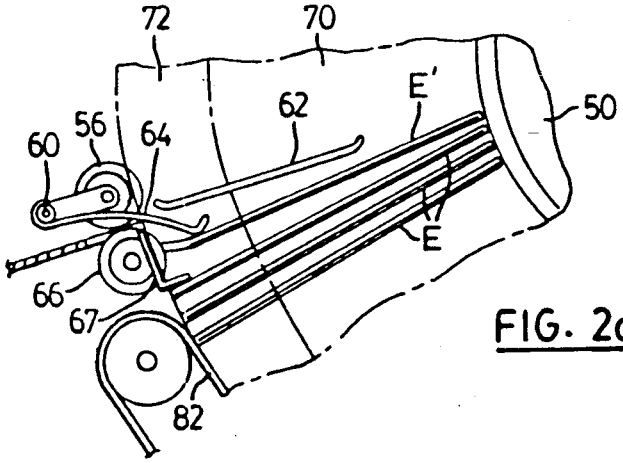
FIGS. 2*a* and 2*b* are detail views of parts of FIG. 2.

FIG. 2*a* shows the positions of envelope E' and deflector springs 64 as the envelope approaches ledge 47. The deflector springs remain generally in the position shown in FIG. 2*a* until the next incoming envelope deflects them upwardly to the position shown in FIG. 2. The springs are prevented from moving beyond this position. As belt 22 continues to advance, the outer ends of the envelopes meet an array of driven belts that are generally indicated by reference numeral 68 in FIGS. 2 and 3 and are shown in more detail in FIG. 3. These belts maintain the envelopes in generally radial positions with respect to the axis of roller 50 and ensure that the envelopes become firmly adhered to belt 22.

Figure 2B:
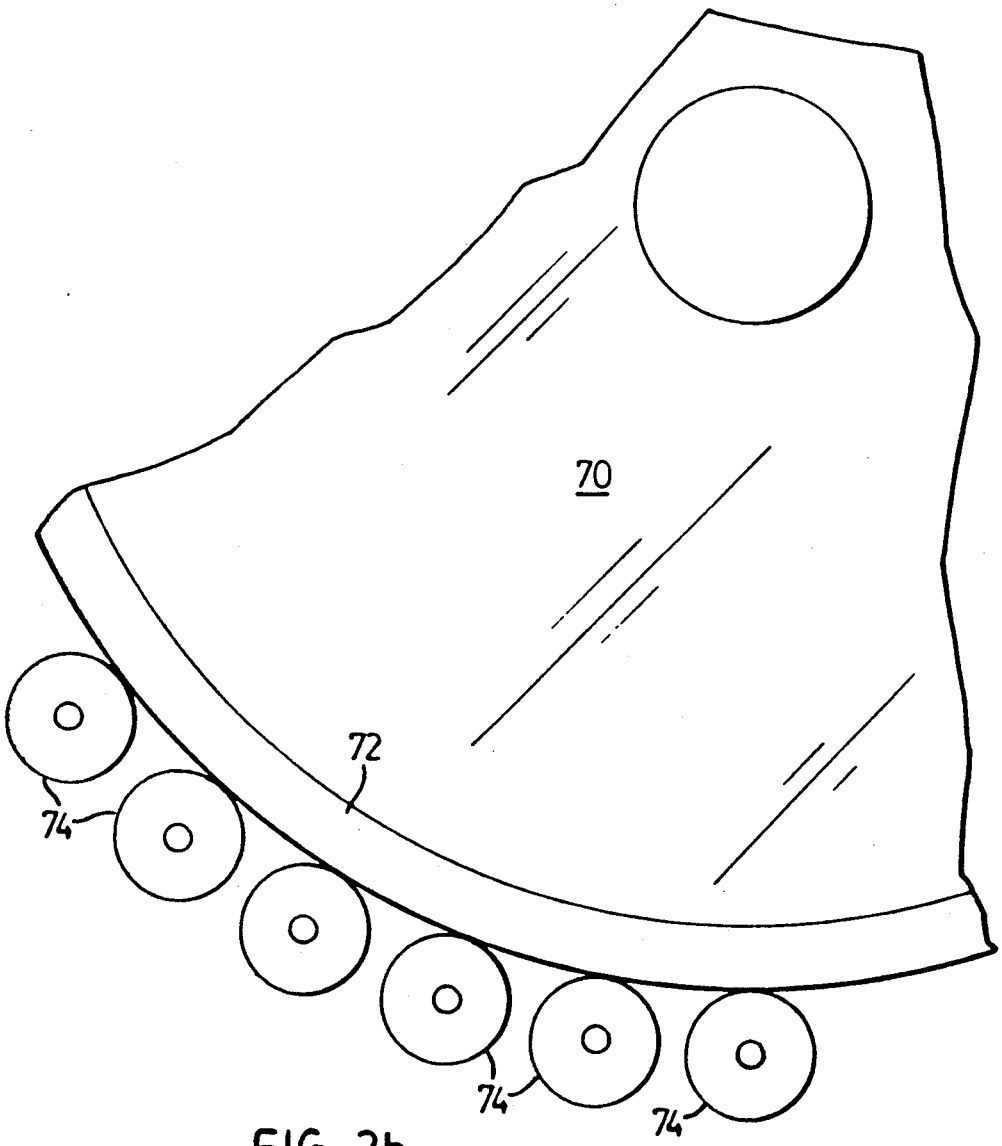

As best seen in FIG. 1, a pair of transparent plastic discs 70 are mounted on roller 50 in parallel planes on opposite sides of belt 22. These discs rotate with roller 50 and serve to frictionally drive the drive belts 68 as will be described in more detail later. Each disc is transparent so as to permit visual inspection of the operation of the portion of the apparatus between the discs. Each disc also has a rubber rim or "tire" on its perimeter for enhanced frictional grip between the discs and drive means for the belts 68. FIG. 2*b* specifically shows frictional engagement between one of these tires 72 and a series of friction rollers 74 for driving belt array 68. Rollers 74 and belt array 68 are not shown in FIG. 1.

Figure 3:
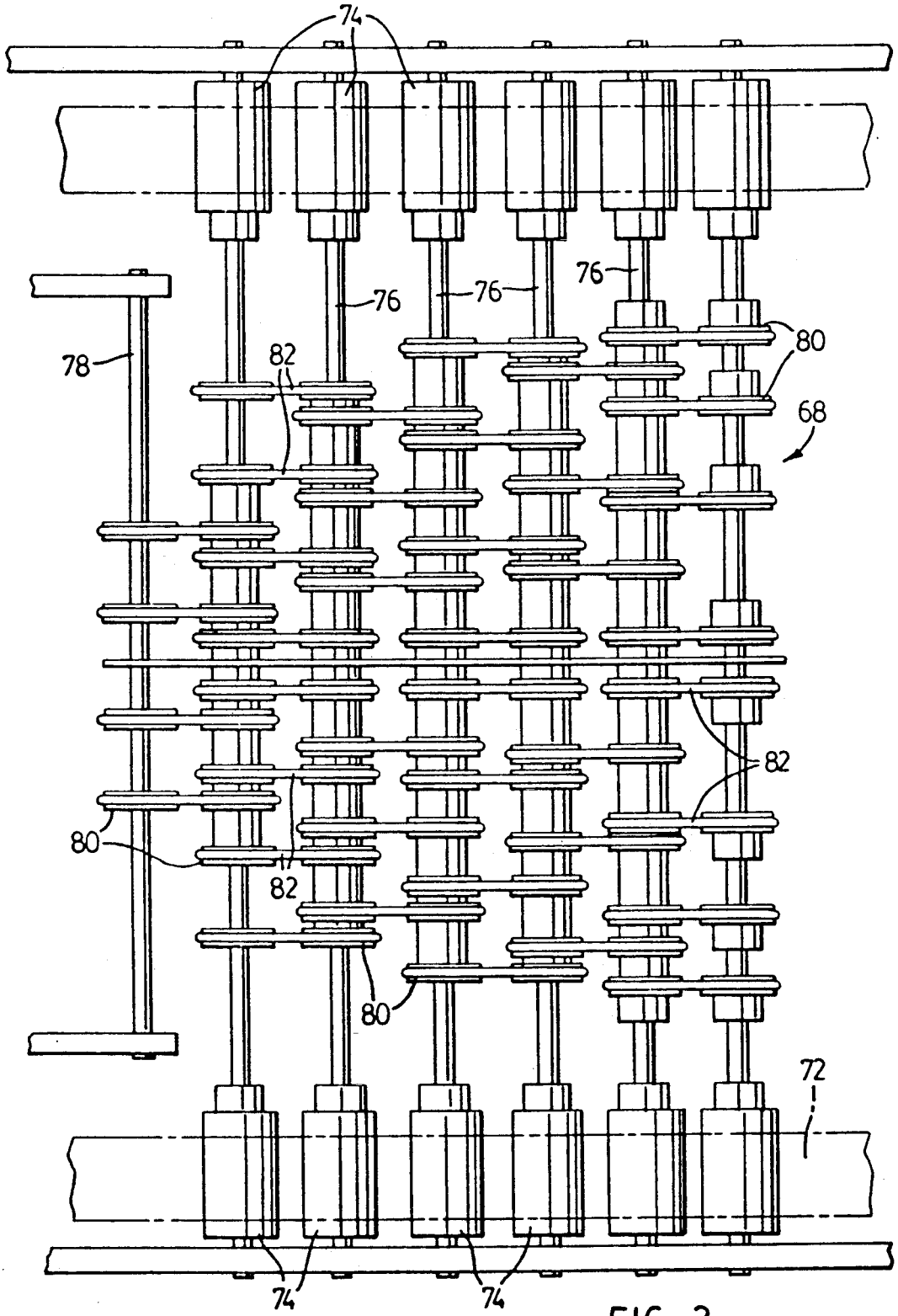
FIG. 3 is a sectional view on line 3—3 of FIG. 1 and as seen in the direction of arrow 3 in FIG. 2.

Referring now to FIG. 3, it will be seen that two groups of friction rollers 74 are provided at respectively opposite ends of a series of shafts 76 that extend parallel to one another and parallel to the axis of roller 50. In this particular embodiment, six shafts 76 are provided plus an additional idler shaft 78 that does not carry friction rollers 74. Pulleys on the respective shafts are indicated by reference numeral 80 and are encircled by drive belts in the form of rubber "O" rings 82. As can perhaps best be seen in FIG. 2, each O ring encircles corresponding pulleys on two adjacent ones of the shafts. The pulleys and O rings are arranged to provide an array or "bed" of drive belts which is contacted by the outer edges of the envelopes as they travel around roller 50 with the main belt 22. These O rings are themselves driven from the discs 70 through the shafts 76 and 78 and the associated pulleys and friction rollers so that the outer edges of the envelopes are conveyed positively at a speed related to the speed of travel of the main belt 22 so that the envelopes are maintained generally radially oriented with respect to the axis of roller 50.

It will also be noted from FIG. 2 that the upper runs of the O ring belts 82 each extend in a line which represents a chord of a circle centred on the axis of roller 50. Since the distance between the centre of each chord and the axis of the roller is slightly less than the distance between each end of the chord and the axis, the O ring belts tend to exert some pressure on the envelopes radially inwardly with respect to roller 50. This helps to firmly adhere the envelopes to the main belt 22.

Figure 4:
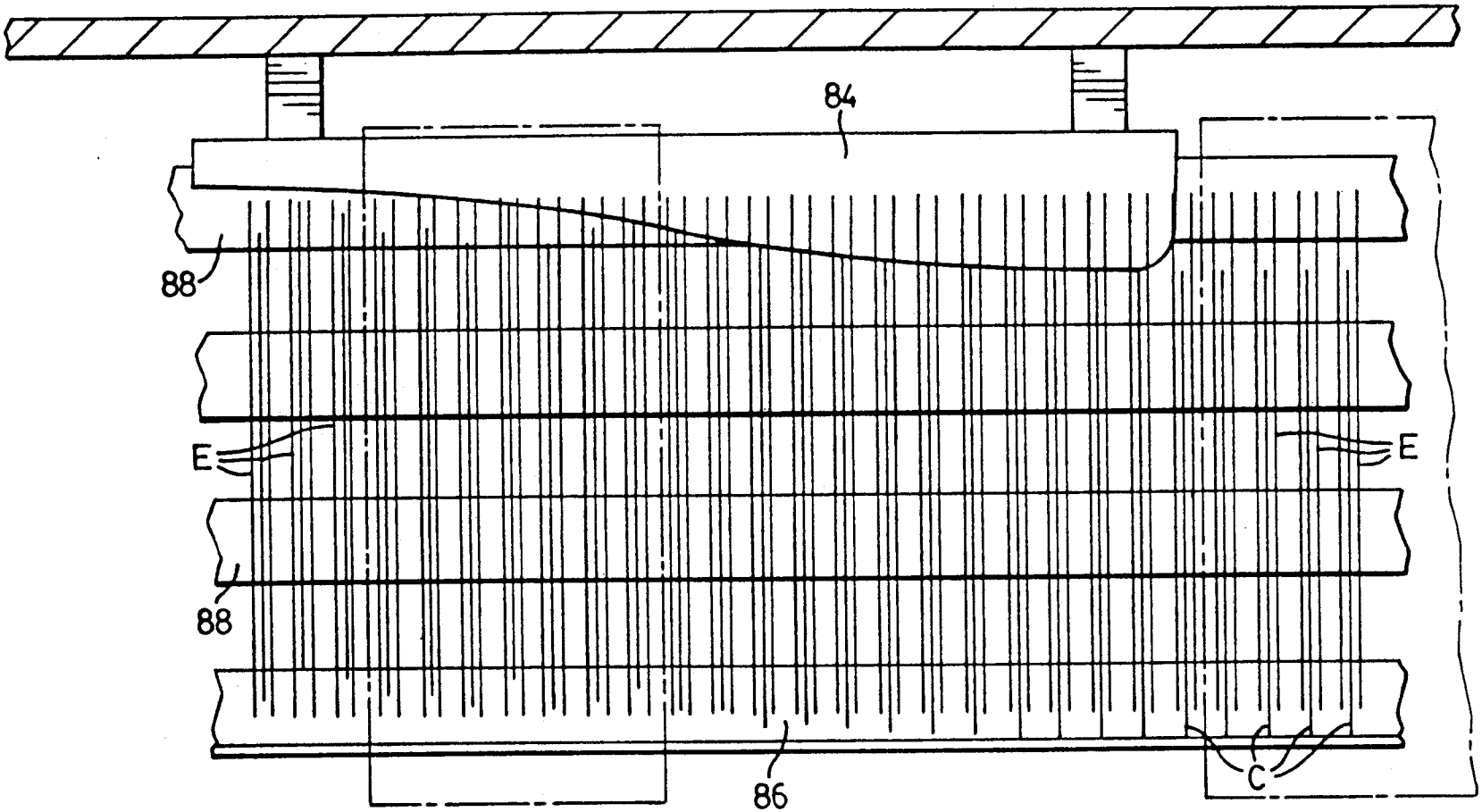
FIGS. 4 and 5 are partial sectional views on lines 4—4 and 5—5 respectively of FIG. 1, showing contents being extracted from envelopes, as with the apparatus in operation.

The array of drive belts 68 extends from a position just below the input conveyor 37 to a position substantially vertically below the centreline of roller 50. As the envelopes reach this position, they hang generally vertically downwardly from the main belt 22. As the envelopes pass beyond the end of the array 68 the contents C within the envelopes E are free to drop out of the envelopes (although this does not always happen). A first one of the two lower belt conveyors 40, 42 shown extends to this position so that any of the contents that do drop at this point will drop onto this conveyor and remain under control. In FIG. 2, the contents of the two leading envelopes are shown as having dropped onto conveyor 40. FIG. 2 also shows a rear guide plate 84 that is provided for the purpose of controlling the positions of the contents laterally on belt conveyor. FIG. 4 shows this rear guide plate and a guide plate 86 adjacent the opposing (front) edge of the conveyor. It will be seen that the front edge guide plate 86 is straight while the rear edge guide plate 84 is profiled to progressively move the contents to the front edge of the conveyor.

Accordingly, the contents of all of the envelopes will be similarly aligned laterally on conveyor 40 by the time they reach the end of the guide plate 84.

FIG. 4, also illustrates the fact that conveyor 40 comprises a series of (three) endless belts 88 which extend parallel to one another longitudinally of the conveyor. As can best be seen from FIG. 1, the belts are in fact set into a table 90 so that only the top runs of the belts are above the table surface. FIG. 1 also illustrates that the second lower belt conveyor 42 is of similar configuration and is similarly arranged but with its (two) belts interleaved with the belts of conveyor 40. Where the two conveyors meet, the respective belts of the two conveyors extend around individual rollers on a common shaft, as generally indicated by reference numeral 92 in FIG. 1.

As discussed previously, the main belt 22 carrying the envelopes is vibrated as it travels from station 36. In this particular embodiment, two vibratory assemblies indicated respectively by reference numerals 94 and 96 are provided for this purpose. These assemblies are shown in detail in FIGS. 11 and 12, which will be described later. It will be seen from FIG. 1 that belt 22 extends generally horizontally past vibratory assembly 94. Between the two assemblies is a roller 98 and the belt begins to incline upwardly as it passes roller 98. The belt then continues in its upward inclination past rollers 100 and 102 until it reaches roller 104 where its direction is reversed; the belt then travels horizontally past tape applying stations 46 and 48.

The vibratory motion that is imparted to belt 22 by the vibratory assemblies 94 and 96 assists in the downward migration of the contents C within the envelopes E that tends to occur under the effect of gravity. It has been found that this vibratory action, coupled with the upward inclination of the main belt will reliably remove the contents from all of the envelopes in sequence.

FIG. 5 shows a portion of the belt in its upwardly inclined orientation, immediately above the junction between the two lower belt conveyors 40 and 42 (FIG. 1). It will be seen that, by the time the envelopes reach the location illustrated in FIG. 5, the contents of the envelopes will have dropped so that their lower edges are resting on the upper run of the first conveyor 40. It will also be seen that the main belt 22 is inclining upwardly away from the lower belt conveyors 40 and 42. Conveyor 40 is driven at the same speed as the main belt 22 so that the envelopes and contents tend to remain substantially vertical until they reach the end of conveyor 40. Conveyor 42 is driven at a slightly greater speed so that the bottom edges of the envelope contents travel more quickly than their upper portions (which are still within the envelopes E). Accordingly, as the envelopes are in effect lifted away from the contents due to the inclination of belt 22, the contents themselves are gently laid rearwardly or "shingled" onto conveyor 40. The sequence of the contents is preserved and the contents lie in an orderly fashion on conveyor 42. The conveyors 40 and 42 and table 90 are vertically adjustable with respect to a fixed base 106 (FIG. 1) to permit adjustment of the spacing between the main belt 22 and the lower belt conveyors in case this should be necessary in order to achieve orderly laying of the contents onto the conveyor or, for example due to variations in the height of the contents.

Figure 6:
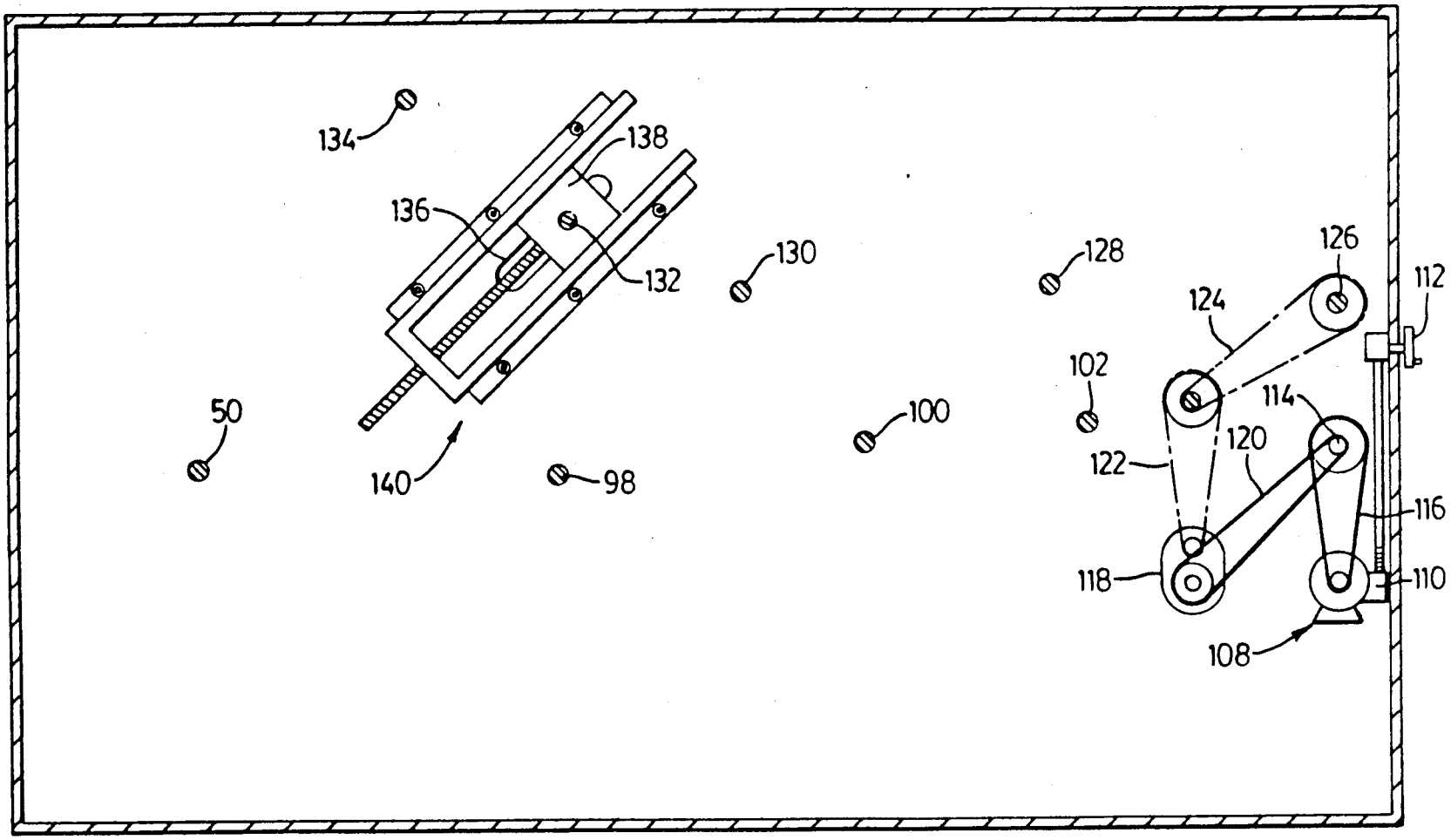
FIG. 6 is a sectional view on line 6—6 of FIG. 1.
Figure 7:
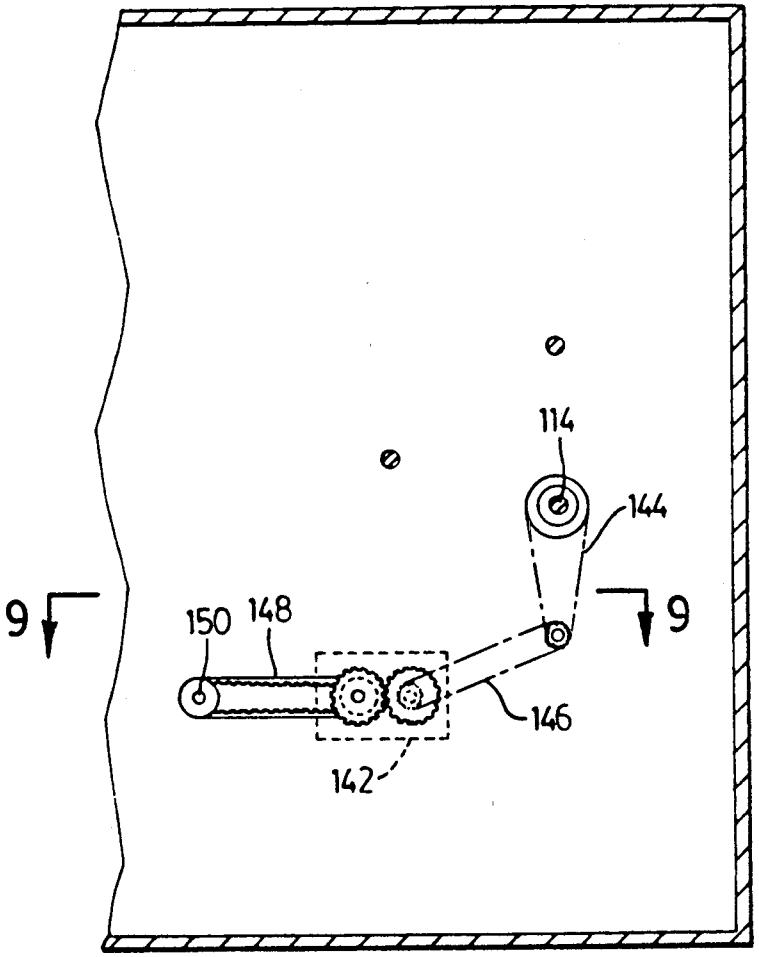
FIG. 7 is a sectional view on line 7—7 of FIG. 9.
Figure 8:
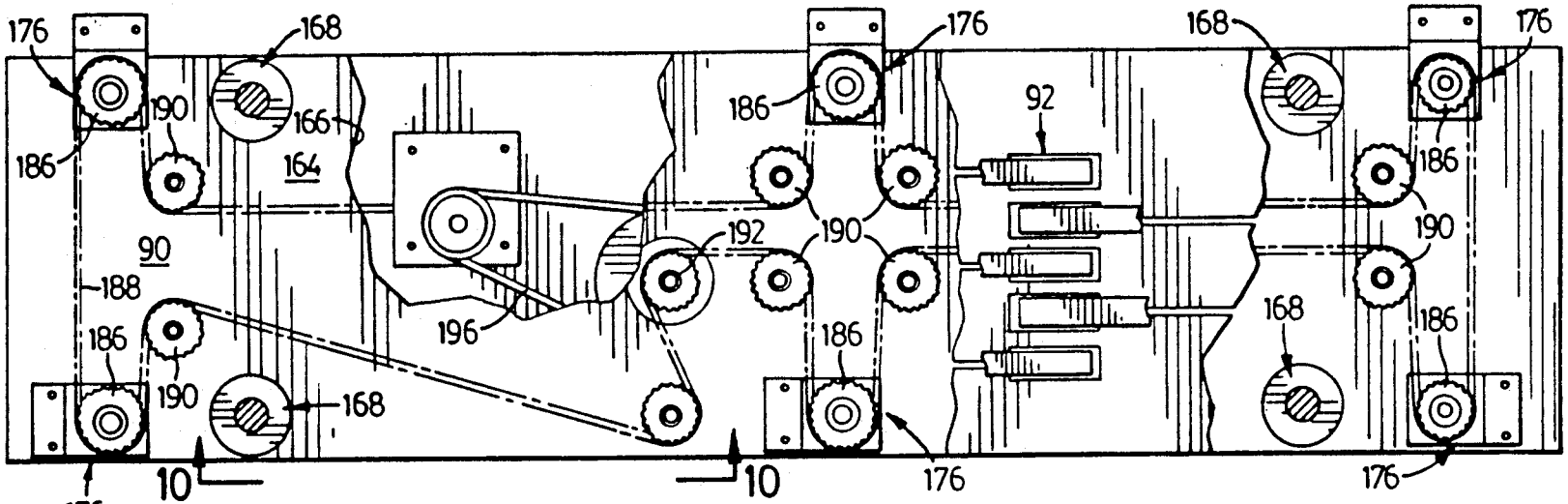
FIG. 8 is a sectional view, partly broken away on line 8—8 of FIG. 1.
Figure 9:
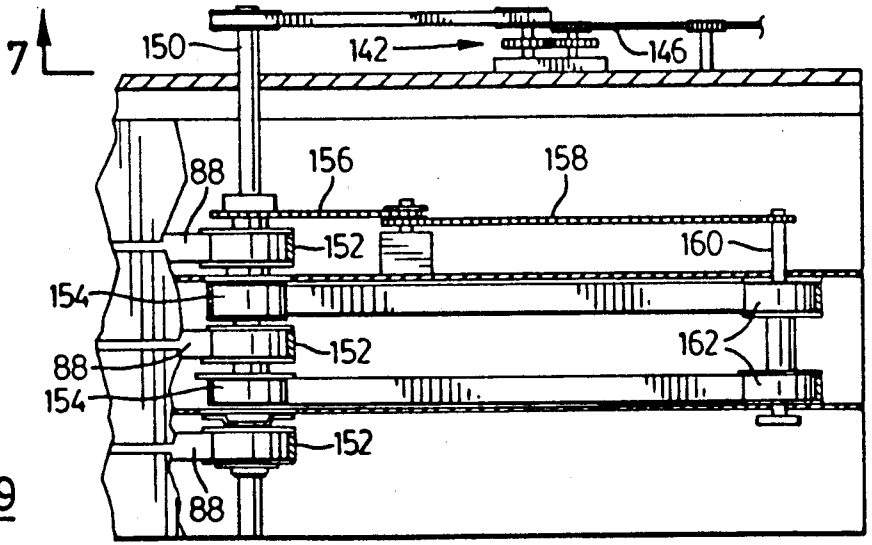
FIG. 9 is a sectional view on line 9—9 of FIG. 1.
Figure 10:
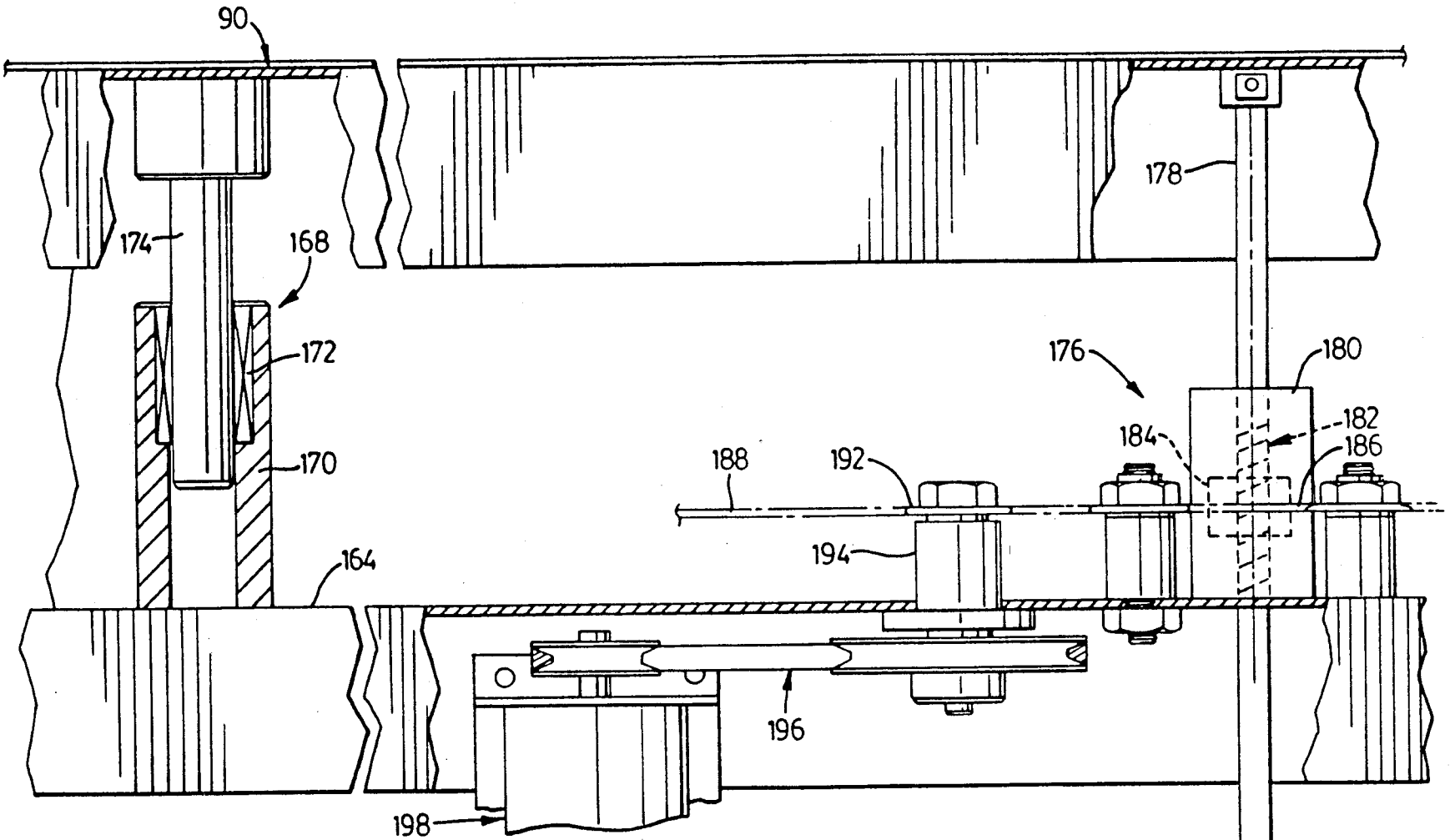
FIG. 10 is a sectional view on line 10—10 of FIG. 8.

A adjustment mechanism for conveyors 40 and 42 is illustrated in FIGS. 8, 9 and 10, which will be described as part of the description of the overall drive system of the apparatus. Reference will first be made to FIGS. 6 and 7 in describing the drive arrangement for the main belt 22 and for the belts of the two conveyors 40 and 42.

FIGS. 6 and 7 show components of the drive system that are accommodated between the two plates 24 an 26 of the main frame of the apparatus (see FIG. 1). These components include a main electric drive motor 108 having a speed control 110 which is adjustable by means of a hand wheel 112. Motor 108 drives a main shaft 114 that extends transversely between the two frame plates 24 and 26, by means of a V-belt 116. A gear box 118 is driven by a second V-belt 120. The gear box output is transmitted by two chain drives 122 and 124 to a second transverse shaft 126 that carries the roller 104 by which the main belt 22 passes at the right hand end of its travel as shown in FIG. 1.

Roller 104 is the main drive roller for the belt. Shafts carrying the other rollers that guide the belt are indicated in FIG. 6 by the reference numerals used in FIG. 1 to denote the rollers themselves. The rollers along the top run of the belt and their shafts are denoted respectively 128, 130, 132 and 134. The shafts extend between the two plates 24 and 26 and are supported by bearings (not shown) carried by both plates. In the case of roller 132, its shaft extends through slots in the two plates. The slot in plate 26 is indicated at 136 in FIG. 6 and the bearings (one of which is indicated at 138) are carried by respective adjusters, one of which is shown at 140, so that the tension in the main belt 22 can be adjusted by adjusting the position of roller 132.

Referring now to FIG. 7, the transverse shaft 114 that is driven directly from drive motor 108 (FIG. 6) drives a gear box 142 via two chain drives 144 and 146. Gear box 142 contains spur gears for changing the direction of the drive and has an output shaft which is coupled by a toothed belt 148 to a drive shaft 150 at the junction between the two lower belt conveyors (location 92 in FIG. 1). Conveyor 40 may be adjusted up or down to maintain satisfactory toothed pulley and toothed belt engagement (see later).

FIG. 9 shows this location as seen in plan. Three spaced drive pulleys 152 for the three belts of the first conveyor 40 are keyed to shaft 150 so that the first conveyor is driven directly from the shaft. Idler pulleys 154 for the two belts of conveyor 42 can turn freely on shaft 150. The second conveyor 42 is also driven from shaft 150 but via two chain drives 156 and 158 to a shaft 160 at the end of conveyor 42 remote from conveyor 41. Pulleys 162 for driving the belts of conveyor 42 are keyed to shaft 160.

FIGS. 8 and 10 illustrate the mechanism for adjusting the height of the lower belt conveyors 40 and 42, and will now be described. FIG. 8 essentially shows the table 90 that carries the two conveyors 40 and 42 in plan. However, as drawn, the top surface of the table is largely broken away to show the drive arrangement except at location 92 of FIG. 1. In FIG. 8, parts of the three belts of the first conveyor are indicated at 40 and parts of the two belts of the second conveyor are indicated at 42. Part of the fixed base 106 below table 90 is visible and is broken away at 166 to show a structure below that plate.

Table 90 is guided for vertical adjustment with respect to the base 106 by four guide posts 168, one of which is shown in detail in FIG. 10. It will be seen that a fixed sleeve 170 extends upwardly from the fixed base 106 and carries a linear ball bearing 172. A cylindrical post 174 projects downwardly from table 90 and is received in bearing 172 for vertical sliding movement All four guideposts are essentially the same.

Vertical adjustment of table 90 is accomplished by six screw jacks 176, one of which is again shown in FIG. 10. A post 178 extends downwardly from table 90 into a housing 180 carried by the fixed base plate 164. Post 178 has an acme screw thread 182 within housing 180 and a nut 184 is carried on that screw thread. The nut is restrained against movement in the axial direction of post 178 and is coupled to a sprocket 186 so that the nut turns when the sprocket is turned. Sprocket 186 is engaged by a drive chain 188. It will be seen from FIG. 8 that chain 188 is an endless chain and travels in a path in which extends around the sprockets 186 of all of the screw jacks 176. Linear movement of the chain in one direction will cause all of the sprockets 186 to turn in the same direction, thereby raising or lowering table 90, depending on the direction of turning.

Various idler sprockets for the chain are individually denoted 190 in FIG. 8. A main drive sprocket for the chain is denoted 192 and is carried by a vertical shaft 194 that extends through the base plate 164 as best seen in FIG. 10. Below the base plate, a V-belt drive 196 couples the drive sprocket 192 with an electric drive motor 198 mounted below the top surface of base 106 with its drive shaft vertical. Motor 198 and its belt drive 196 are also visible in FIG. 8 within the broken away portion 166 of base 106.

Figure 11:
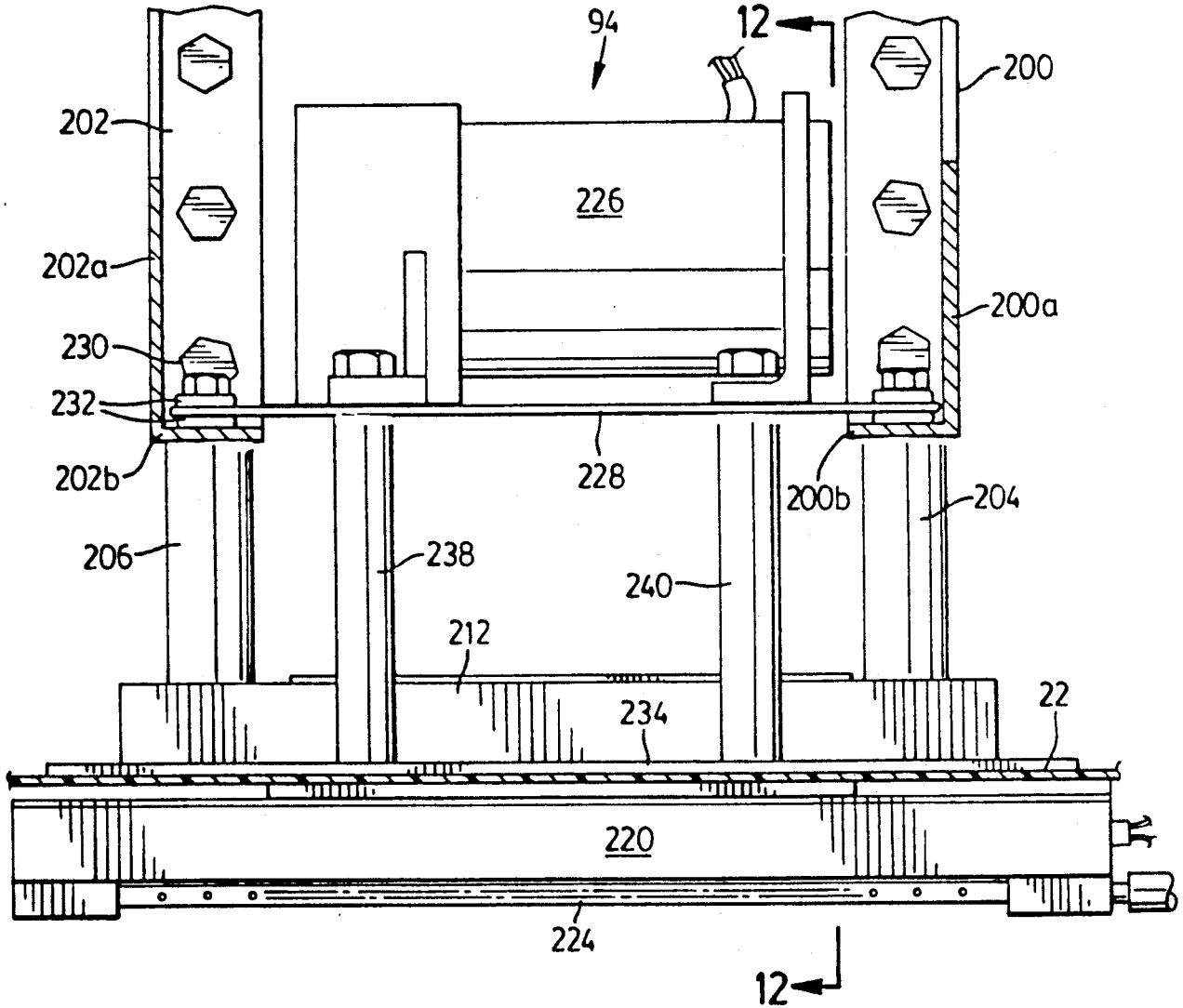
FIG. 11 is a partial sectional view on an enlarged scale in the direction of arrows 11—11 of FIG. 1 as seen on section line 11—11 of FIG. 12.
Figure 12:
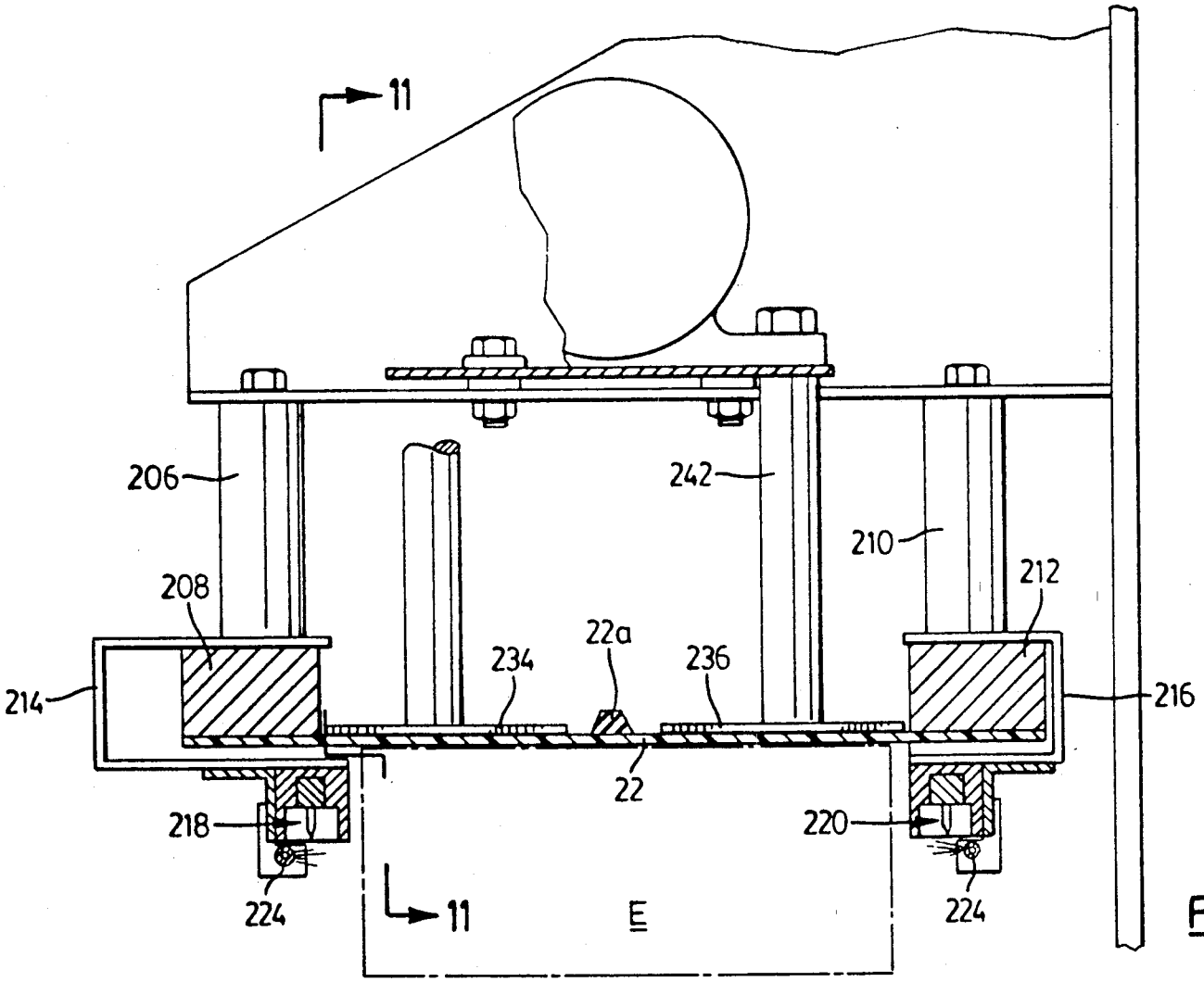
FIG. 12 is a sectional view on line 12—12 of FIG. 11.

Referring now to FIGS. 11 and 12, the two vibratory assemblies 94 and 96 of FIG. 1 are essentially identical. Both assemblies are bolted to the base plate 24 of the apparatus; assembly 96 is inclined slightly with respect to assembly 98 so as to match the inclination of the belt. Assembly 94 will now be described as representative of both assemblies.

Assembly 94 includes a pair of generally triangular mounting brackets 200, 202, each of which has a rear flange 200*a* and 202*a* respectively, by which the brackets are bolted to the base plate 24, and bottom flanges 200*b* and 202*b*. Two posts extend rigidly downwardly from each of the bottom flanges of the respective brackets. The two outermost posts of the respective brackets are denoted 204 and 206 and carry a first rectangular block 208 that extends along the outer edge of and above the belt 22 (see FIG. 12) while the corresponding two rear posts (only one of which is visible and is denoted 210) carry a similar block 212 that extends along the top of the inner edge of the belt. These two blocks carry mounting brackets 214 and 216 for respective ionizing devices 218 and 220. As best seen in FIG. 12, these devices extend below opposite longitudinal margins of the belt, on either side of the envelopes that hang down from the belt. Each device is provided with an air discharge tube 222, 224 arranged to blow air inwardly toward the envelopes. The effect of this arrangement is that ionized air produced by the devices 218 and 220 is blown over the envelopes, to remove static electricity that would otherwise tend to hold the contents C within the envelopes E.

A vibrator unit 226 is bolted to a mounting plate 228 and the mounting plate is in turn bolted to the bottom flanges 200*b* and 202*b* of brackets 200, 202 by bolts which are individually denoted 230 and each of these bolts is provided with rubber bushes 232 that serve to resiliently support the mounting plate.

Referring again to FIG. 12, it will be seen that two rectangular plates 234 and 236 are provided in contact with the top surface of the main belt 22 inwardly of the respective mounting blocks 208 and 212. These plates extend over substantially the entire length of the vibratory assembly. The outermost one of the plates (234) is rigidly connected to the vibrator unit mounting plate 228 by a front pair of posts 238 and 240 (FIG. 11), while the inner plate 236 is similarly connected to the mounting plate by two rear posts, one of which is visible in FIG. 12 at 242.

Vibrator unit 226 is essentially an electric motor driving a shaft fitted with an eccentric weight so that the unit vibrates quite severely when the motor runs. These vibrations are transmitted to the plates 234 and 236 and, from there, to the belt and to the envelopes suspended from the belt.

Reference will now be made to FIGS. 13 to 18 in describing parts of the apparatus that (a) remove the contents of the envelopes from the outer end of conveyor 42 (FIGS. 13 and 18), (b) strip the empty envelopes from the belt 22 and check that those envelopes are indeed empty (FIGS. 13 to 17).

Figure 13:
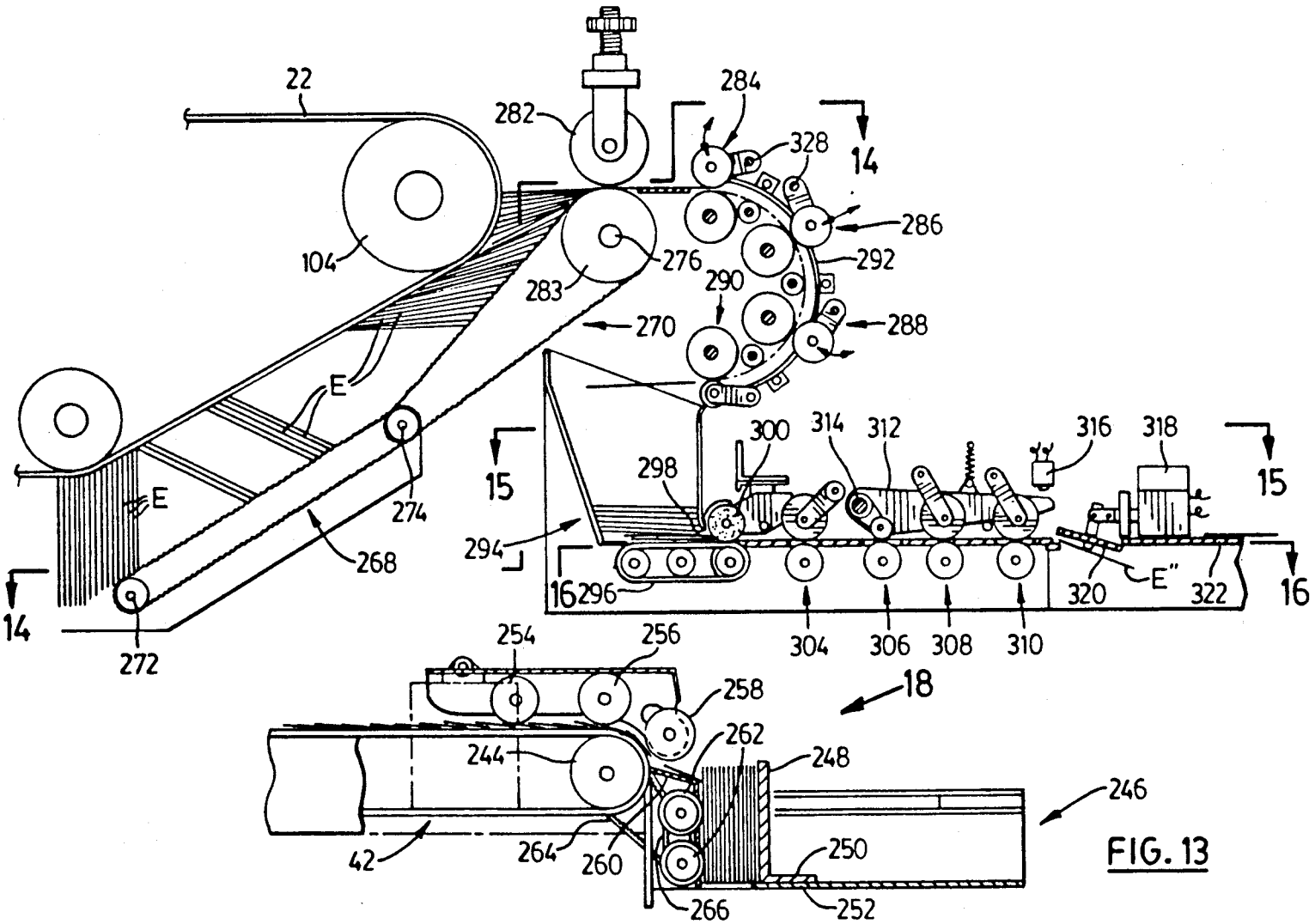
FIG. 13 is an enlarged detail view in the direction of the arrows denoted 13 in FIG. 1.
Figure 18:
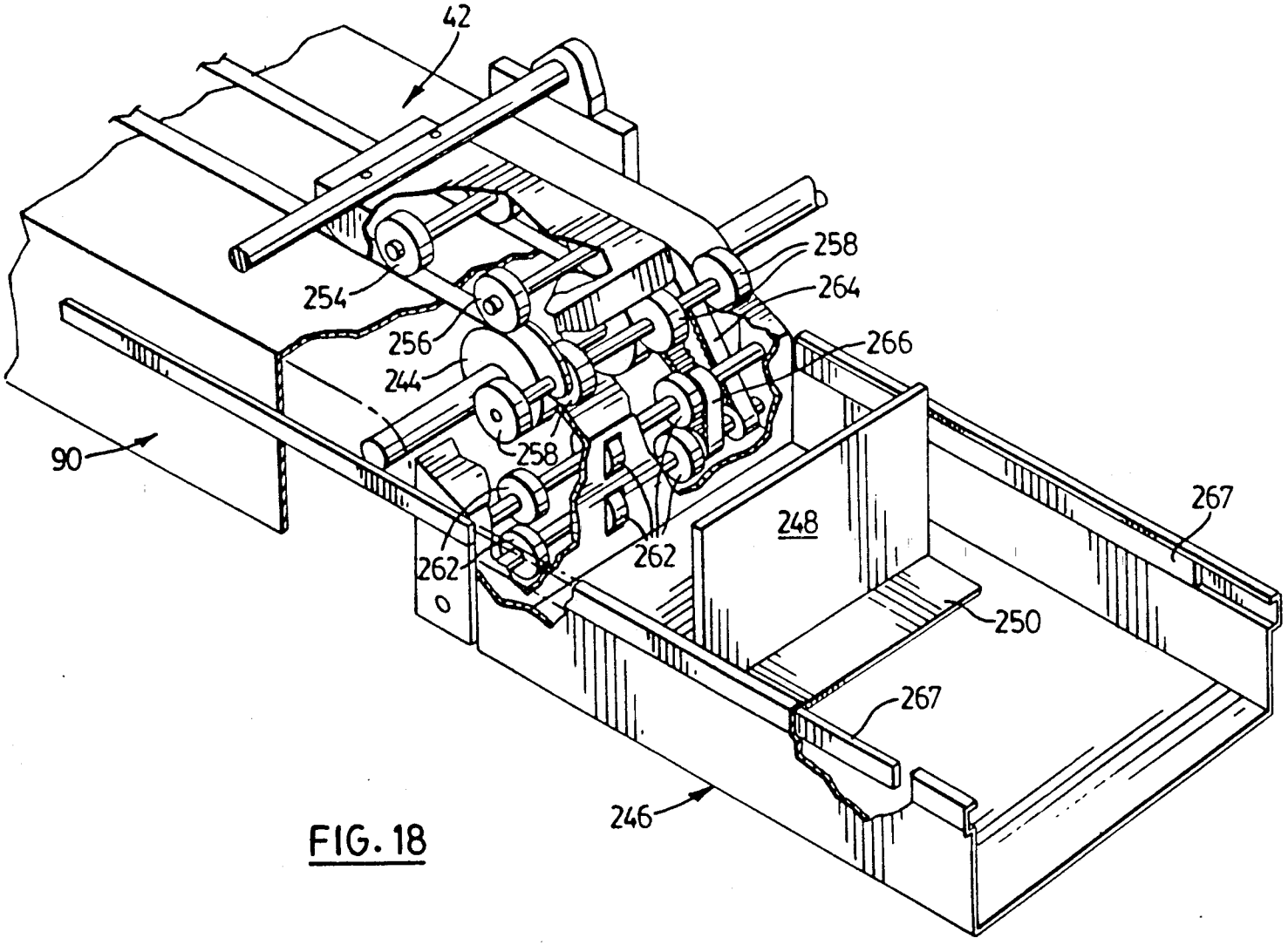
FIG. 18 is a perspective view in the direction of arrow 18 in FIG. 13.

Dealing first with removal of the envelope contents, the outer end portion of the lower belt conveyor 42 is visible in the lower portion of FIG. 13 and in FIG. 18. The belts of that conveyor are shown extending around a toothed pulley 244 at the outer end of the conveyor. In FIG. 13, the contents C that have been removed from the envelopes are shown in a "shingled" configuration on the top runs of those belts. A bin 246 to receive the contents C is provided downstream of the end of the conveyor. As best seen in FIG. 18, bin 246 is open at its outer end but has a movable end plate 248 that has at its lower edge a flange 250 that rests on the bottom of the bin. A felt pad 252 is provided on the lower surface of flange 250 to allow the end plate to slide along the bottom of the tray.

Referring back to FIG. 13, three successive sets of pinch rollers 254, 256 and 258 co-operate with conveyor 42 and with a deflector plate 260 to direct the individual pieces of paper comprising the contents C successively into the "near" end of tray 246 in vertical orientation. The leading end of each piece of paper strikes those pieces that are already in the tray and is driven downwardly by rollers 262 into a vertical position. As a result, the individual pieces of paper form a vertical stack in tray 246. FIG. 18 shows that the rollers 262 protrude through openings in an end plate that is a vertical continuation of the deflector plate 260. Rollers 262 are driven by toothed belts 264 and 266 from conveyor 42.

Referring to FIG. 18, tray 246 is slidably supported on rails 267 so that the tray can be removed as a unit simply by sliding it off the rails 268. This allows the collected contents to be removed in batches for processing.

The upper portion of FIG. 13, in conjunction with FIGS. 14 to 17, illustrates the mechanism for stripping the empty envelopes from the main belt 22 of the apparatus and verifying that they are indeed empty.

Referring back to FIG. 1, it will be seen that the main belt 22 inclines upwardly from roller 98 to roller 102 and then inclines more steeply between roller 102 and roller 104. FIG. 13 shows this relatively steeply inclined end portion of the belt run. At the beginning of the run, the envelopes E hang generally vertically down from the belt. As the envelopes begin to move around roller 102 their lower end portions encounter the first of two belt conveyors 268 and 270. As can be seen from FIGS. 1 and 14, each conveyor in fact comprises a series of parallel endless belts having ribbed outer surfaces. The belts extend around said respective pulleys on shafts 272, 274 and 276. The shafts extend between a back plate 278 which is essentially a continuation of plate 24 (FIG. 1) and a front plate 280 which has been omitted from FIG. 1 for the sake of clarity.

As best seen in FIG. 13, the first conveyor 268 extends parallel to the relevant run of the main belt 22 and is slightly closer to that belt than the height of the envelopes E. The conveyor is driven faster than the main belt 22 so that the envelopes are in effect rotated forwardly at their lower ends about the edges that are attached to the main belt 22. Conveyor 270 converges with the main belt so that the envelopes are brought to positions at which they lie generally parallel to the belt as it approaches the main driving roller 104.

As the belt continues to move, the outer end portions of the envelopes successively enter the nip between a pair of pinch rollers 282, 283 which in effect pull the envelopes one by one off the adhesive tape on belt 22. The envelopes are then fed individually by pairs of pinch rollers 284, 286, 288 and 290 around a semicircular guide 292 and into a bin 294. The envelopes are ejected generally horizontally into the bin and accumulate in a vertical stack.

The bottom surface of the bin is formed by a belt conveyor 296 which ejects the envelopes individually through a slot 298 in the bin. A series of stone rollers 300 adjacent slot 298 but outside the bin co-operate with the belt conveyor 296 to ensure that the envelopes are fed individually from the bin. From here, the envelopes pass through the nip between a series of pairs of driven rollers 304, 306, 308 and 310. The second pair 306 of rollers acts as a thickness monitor. Both rollers are made of solid steel and the upper roller of the pair is mounted on an arm 312 that is pivoted at a pivot point 314 adjacent one end of the arm. A microswitch 316 is positioned adjacent the opposite end of the arm and is located at a spacing from that end such that the microswitch will not normally be actuated as that end of the arm moves up and down due to empty envelopes passing through the nip between rollers 306. However, microswitch will be activated if a thicker envelope is encountered. In that event, microswitch 316 will operate a solenoid 318 that will open a gate 320 to eject the envelope in question (denoted E''). That envelope can then be manually checked and, if necessary, stripped of contents that were not removed previously. Envelopes that are not ejected continue along a guideway 322 and are collected in a final bin (not shown).

Figure 14:
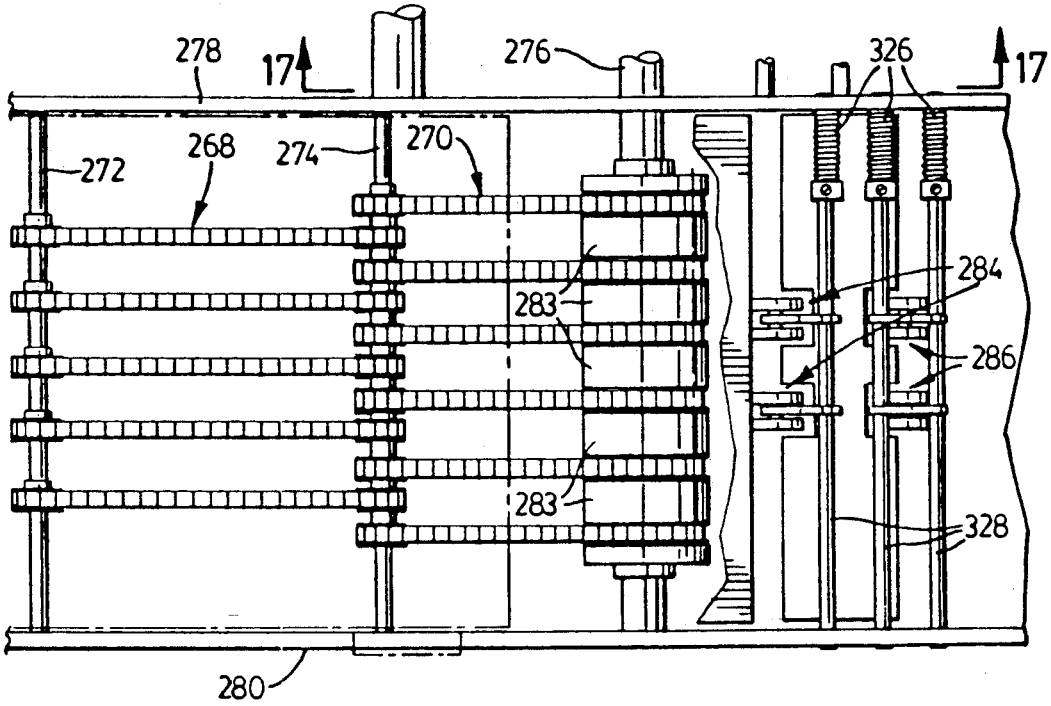
FIGS. 14, 15 and 16 are sectional views on the correspondingly denoted section lines in FIG. 13.

FIGS. 14 to 17 illustrate various constructional details of the portion of the apparatus that has just been described. The following elements in particular should be noted. In FIG. 14, the shaft 276 at the outer end of conveyor 270 carries a series of plastic rollers 283 between the belts. These are the lower pinch rollers 283 that co-operate with rollers 282 to strip the envelopes from the belt (FIG. 13). FIG. 14 also shows the upper ones of the pairs of pinch rollers 284 and 286 and illustrates torsion springs 326 on pivot shafts 328 for those rollers. The torsion springs maintain the pinch between those rollers and the corresponding pairs of rollers below guide 292 (FIG. 13).

Figure 15:
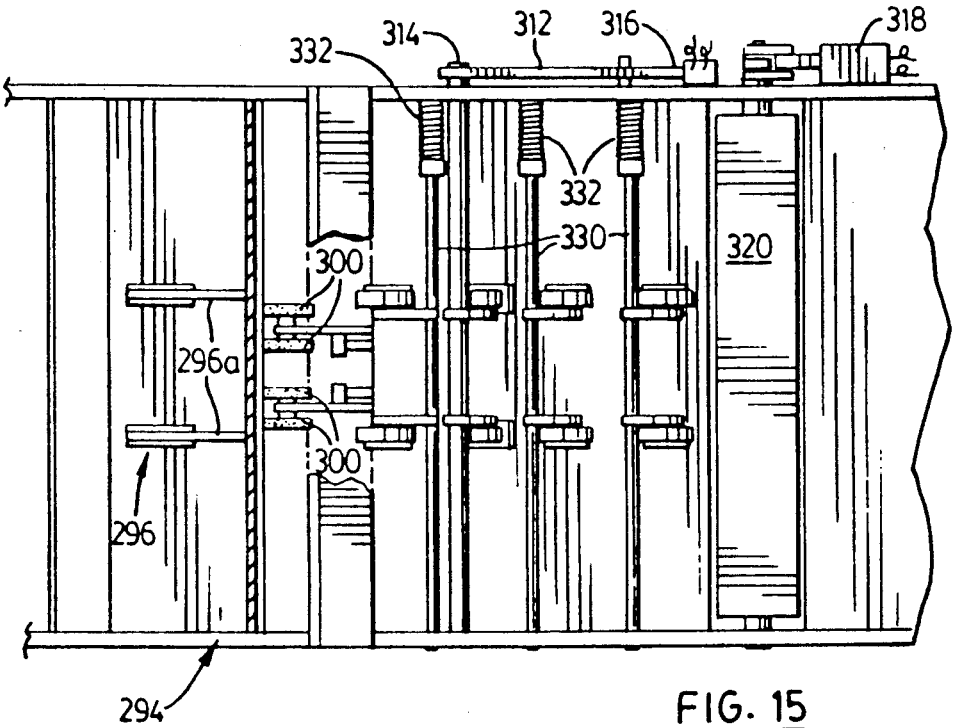

FIG. 15 is a plan view of bin 294 and the pinch rollers downstream of that bin. The bin is shown empty in FIG. 15 to illustrate the fact that conveyor 296 comprises pairs of endless driven rubber belts, denoted 296*a*. FIG. 15 also shows the upper rollers of the pairs of pinch rollers 304, 306, 308 and 310 as well as pivot shafts 330 and associated torsion springs 332 for the upper rollers of pairs 304, 308 and 310. The pivot shaft for arm 312 is visible at 314.

Figure 16:
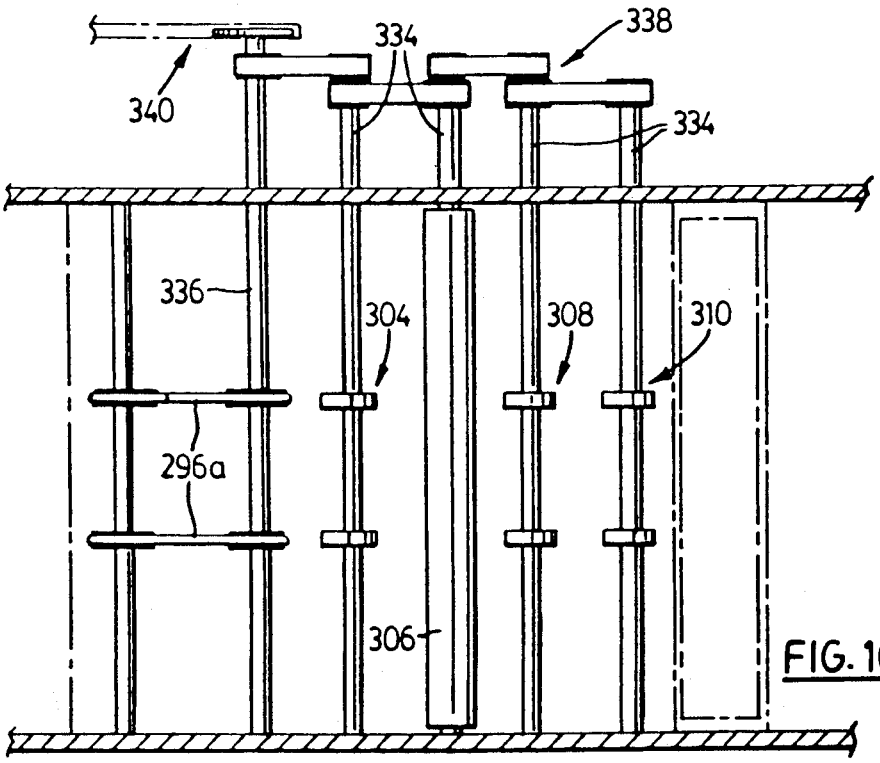

FIG. 16 shows pivot shafts 334 for the lower rollers of pairs 304, 306, 308 and 310 as well as a drive shaft 336 for conveyor belts 296*a*. All of these shafts are driven by toothed belt drives 338 which in turn are driven by a chain 340 from the main drive shaft 114 shown in FIG. 6. It will be seen that a single solid roller is used as the lower roller of pair 306.

Figure 17:
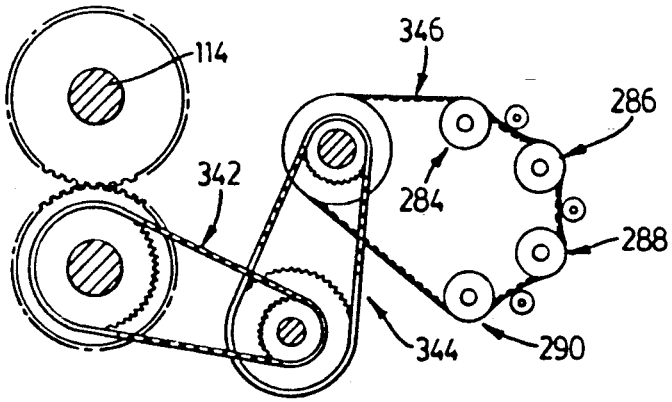
FIG. 17 is a sectional view on line 17—17 of FIG. 14.

Finally, FIG. 17 shows the connection from shaft 114 through chain and sprocket drives 342 and 344 to an endless belt 346 that drives the inner rollers of the pinch roller pairs 284, 286, 288 and 290 shown in FIG. 13.

It will be appreciated from the foregoing that the method and apparatus of the invention provides means for extracting the contents of a continuous stream of envelopes in an efficient and rapid manner. It is anticipated that the apparatus shown in the drawings will be capable of reliably handling envelopes at a rate equal to the rate at which envelopes can be delivered to the apparatus from a TRI-CUT 3-WAY LETTEROPENER. The apparatus also provides means for retrieving the contents of the envelopes in an orderly fashion, stripping the empty envelopes from the belt of the apparatus, verifying that they are indeed empty and delivering the empty envelopes to a suitable bin from which they can be disposed of, e.g. for recycling.

It will be understood that the embodiment described is a particular preferred embodiment only and that many modifications are possible within the broad scope of the invention. For example, the particular belt configuration, the means used to vibrate the belt and the number of such means employed can of course vary. The empty envelopes may be stripped from the belt by other forms of stripping mechanism and the extracted contents can of course be handled differently. Other variations will occur to a person skilled in the art.

I claim:

1. A method of extracting the contents of envelopes, each of which has been opened along at least one edge and has an opposite edge which is unopened, the method comprising the steps of:

providing a travelling belt having an adhesive surface;

causing each of a succession of said envelopes to adhere to the belt transversely thereof, by projecting each envelope against said surface with its unopened edge leading;

subsequently orienting the belt so that the envelopes are suspended from the belt; and, vibrating the belt while the envelopes remain suspended therefrom, to cause the contents of the envelopes to migrate downwardly and leave the envelopes.

2. A method as claimed in claim 1, wherein said travelling belt is an endless belt and wherein the method further comprises the step of causing said belt to continuously circulate successively through a first station at which said step of causing said envelopes to adhere to the belt is performed, a second station at which said step of vibrating the belt is performed, and a third station, and wherein the method comprises the further step of stripping the envelopes from the belt at said third station.

3. A method as claimed in claim 1, wherein said adhesive surface is provided by a plurality of adhesive strips that extend longitudinally of the belt, the remainder of the belt being non-adhesive.

4. A method as claimed in claim 2, wherein said adhesive surface is provided by a plurality of adhesive strips that extend longitudinally of the belt, the remainder of the belt being non-adhesive, wherein a fourth station is provided between said third station and said first station and wherein the method comprises the further steps of periodically renewing the adhesive by applying strips of adhesive to the belt at said fourth station.

5. A method as claimed in claim 2, wherein said belt travels around a roller at said first station, and wherein said step of causing said envelopes to adhere to the belt is performed by projecting each successive envelope at the belt generally in a plane containing a longitudinal axis of the roller, whereby the belt is supported by the roller as each envelope impacts against the belt.

6. A method as claimed in claim 5, wherein said roller is disposed with its said axis horizontal, wherein said plane in which the envelopes are projected is inclined upwardly towards said axis with the belt travelling downwardly towards said plane, and wherein the method comprises the further step of maintaining each envelope in engagement with the belt after the envelope has been projected against the belt and during a portion of the belt movement sufficient to bring the envelope to a position in which it is suspended generally vertically downwardly from the belt.

7. A method as claimed in claim 6, comprising the further step of providing below said belt conveyor means to receive the contents of the envelopes after each envelope has arrived at said generally vertical position, said second station being located adjacent but downstream of said roller in the direction of belt travel so that the belt is subjected to said vibration while travelling above said conveyor means.

8. A method as claimed in claim 7, comprising the further steps of positioning said belt and conveyor means at a vertical spacing from one another selected to permit lower edges of the contents of the envelopes to drop into contact with the conveyor means while upper portions of said contents remain within the respective envelopes, said spacing increasing progressively with increasing distance from said roller, and, subsequently causing the conveyor means to move said lower edges of the contents faster than the belt, so that the contents are laid in an orderly shingled configuration onto the conveyor means.

9. A method as claimed in claim 8, comprising the further step of aligning the contents of the envelopes as they are laid onto the conveyor means.

10. A method as claimed in claim 8, comprising the further step of conveying the contents downstream from said conveyor means and orienting the contents into a vertical stack.

11. A method as claimed in claim 2, wherein said belt path is selected to cause the belt to reverse its direction of travel at said third station, and wherein the method comprises the further steps of providing envelope stripper means at said third station, said stripper means comprising at least one roller pair forming a nip adjacent said belt, and orienting the envelopes on the belt so as to cause lower end portions of the envelopes to be fed into said nip immediately before the belt reverses its direction of travel so that the envelopes are gripped by the rollers and thereby removed from the belt as said direction of travel reverses.

12. A method as claimed in claim 11, further providing means for monitoring the thickness of the envelopes stripped from the belt, and segregating envelopes above a predetermined thickness.

13. An apparatus for extracting the contents of envelopes, each of which has been opened along at least one edge and has an opposite edge which is unopened, the apparatus comprising:

a belt having an adhesive surface;

means for transporting the belt in the direction of its length;

means for projecting against said adhesive surface of the belt, a succession of said envelopes each with its unopened edge leading and disposed transversely of the belt, so as to cause the envelope to adhere to the belt by its said unopened edge;

said belt transport means being adapted to orient the belt so that the envelopes hang down from the belt; and, means for vibrating the belt so as to cause the contents of the envelope to migrate downwardly and leave the envelopes.

14. An apparatus as claimed in claim 13, wherein said belt is an endless belt arranged to be transported in a path which includes a first station having said means for projecting envelopes against the adhesive surface of the belt, a second station having said means for vibrating the belt, and a third station having means for stripping envelopes from the belt.

15. An apparatus as claimed in claim 13, wherein said adhesive surface of the belt is provided by a plurality of adhesive strips that extend longitudinally of the belt, the remainder of the belt being non-adhesive.

16. An apparatus as claimed in claim 14, wherein said adhesive surface of the belt is provided by a plurality of adhesive strips that extend longitudinally of the belt, the remainder of the belt being non-adhesive, wherein a fourth station is provided between said third station and said first station along the path of the belt, and wherein the apparatus further comprises means for applying strips of adhesive to the belt at said fourth station, said means being operable to periodically renew the adhesive surface on the belt.

17. An apparatus as claimed in claim 14, further comprising a roller around which said belt is arranged to travel at said first station, wherein said means for projecting envelopes against the belt is arranged to project each successive envelope at the belt generally in a plane containing a longitudinal axis of said roller, whereby the belt is supported by the roller as each envelope impacts against the belt.

18. An apparatus as claimed in claim 17, wherein said roller is disposed with its said axis horizontal, wherein said projecting means is arranged so that said plane in which the envelopes are projected is inclined upwardly towards said axis and said transport means is arranged to transport the belt downwardly towards said plane, the apparatus further comprising conveyor means for engagement with outer edges of envelopes which have been adhered to the belt, said conveyor means being arranged to maintain each envelope in engagement with the belt after the envelope has been projected against the belt and during a portion of the belt movement sufficient to bring the envelope to a position in which it is suspended generally vertically from the belt.

19. An apparatus as claimed in claim 18, wherein said conveyor means comprises an array of endless belts, each extending around two pulleys rotatable about axes parallel to said roller axis and angularly spaced with respect to said axis so that the inner run of each belt defines a chord of a circle centred on said roller axis and having a radius equal to the radial distance of the outer edge of an envelope adhered to the belt at the position of said roller, from the axis of said roller.

20. An apparatus as claimed in claim 18, further comprising second conveyor means positioned below said belt to receive the contents of the envelopes after each envelope has arrived at said generally vertical position and deliver said contents to a discharge location, said second station being located adjacent but downstream of said roller in the direction of belt travel, said conveyor means extending below said second station.

21. An apparatus as claimed in claim 20, wherein said belt and second conveyor means are positioned at a vertical spacing from one another selected to permit lower edges of the contents of the envelopes to drop into contact with the conveyor means, while upper portions of the contents remain within the respective envelopes, the spacing between the belt and second conveyor means increasing progressively with increasing distance from the roller and said second conveyor means being adapted to move said lower edges of the contents faster than the belt, so that contents are laid in an orderly shingled configuration onto the conveyor means.

22. An apparatus as claimed in claim 21, wherein said second conveyor means comprises two belt conveyors, one of which extends from a position below the roller to a downstream position beyond said second station, and travels at a first speed, while the other belt conveyor forms a continuation of the first mentioned belt conveyor and travels at a second speed greater than the speed of the belt, selected to cause the contents of the envelopes to be laid in said orderly shingled configuration onto the conveyor means.

23. An apparatus as claimed in claim 21, further comprising means for conveying the contents of the envelopes from said conveyor means and orienting said contents into a vertical stack.

24. An apparatus as claimed in claim 14, wherein said belt path is selected to cause the belt to reverse its direction of travel at said third station, and wherein the apparatus further comprises envelope stripper means at said third station, said stripper means comprising at least one roller pair forming a nip adjacent said belt, and means for orienting the envelopes on the belt so as to cause lower end portions of the envelopes to be fed into said nip immediately before the belt reverses its direction of travel, so that the envelopes are gripped by the rollers and thereby removed from the belt as said reversal occurs.

25. An apparatus as claimed in claim 24, further comprising means for monitoring the thickness of the envelopes stripped from the belt, and segregating envelopes above a pre-determined thickness.

26. An apparatus as claimed in claim 13, wherein said means for vibrating the belt comprises at least one vibratory assembly comprising a vibrator unit and means for transmitting vibrations from said unit to said belt, comprising plate means in planar contact with a surface of the belt opposite said adhesive surface.

27. An apparatus as claimed in claim 26, wherein said vibratory assembly further comprises respective ionizing devices carried by said assembly and positioned on opposite sides of and below the belt, and means for directing ionized air produced by said devices inwardly of the belt and across envelopes suspended from the belt.

* * * * *